US011538645B2

(12) United States Patent
Lilja

(10) Patent No.: US 11,538,645 B2
(45) Date of Patent: Dec. 27, 2022

(54) ELECTRIC SWITCH

(71) Applicant: ABB Schweiz AG, Baden (CH)

(72) Inventor: Juuso Lilja, Vaasa (FI)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 17/450,225

(22) Filed: Oct. 7, 2021

(65) Prior Publication Data

US 2022/0115198 A1 Apr. 14, 2022

(30) Foreign Application Priority Data

Oct. 14, 2020 (EP) ..... 20201702

(51) Int. Cl.
*H01H 33/02* (2006.01)
*H01H 33/70* (2006.01)

(52) U.S. Cl.
CPC ..... *H01H 33/7015* (2013.01); *H01H 33/02* (2013.01)

(58) Field of Classification Search
CPC .. H01H 33/7015; H01H 33/02; H01H 1/2041; H01H 1/2058; H01H 1/5822; H01H 1/42; H01H 1/365; H01H 1/14; H01H 1/36; H01H 9/341; H01H 9/342; H01H 9/383; H01H 71/08; H01H 73/045; H01H 19/46; H01H 19/64; H01H 9/345; H01H 9/362; H01H 2009/365; H01H 33/04; H01H 33/10
USPC .... 218/146, 15, 16, 34, 38, 46, 76, 81, 103, 218/105, 149, 151, 156
See application file for complete search history.

(56) References Cited

U.S. PATENT DOCUMENTS 2,314,693 A * 3/1943 Dickinson ..... H01H 71/122 337/179
4,139,747 A * 2/1979 Kelly ..... H01H 33/02 200/48 KB
4,362,915 A * 12/1982 Swindler ..... H01H 33/123 218/149
7,186,941 B2 * 3/2007 Yeon ..... H01H 9/346 218/15
9,431,197 B2 8/2016 Engewald
2013/0327618 A1 * 12/2013 Mattlar ..... H01H 19/36 200/11 R
2016/0181029 A1 * 6/2016 Välivainio ..... H01H 19/10 218/151
2019/0326073 A1 * 10/2019 Strand ..... H01H 33/08

FOREIGN PATENT DOCUMENTS

EP 3457423 A1 3/2019

OTHER PUBLICATIONS

Extended European Search Report; Application No. 20201702.6; Completed: Mar. 1, 2021; dated Mar. 10, 2021; 6 Pages.

* cited by examiner

*Primary Examiner* — William A Bolton
(74) *Attorney, Agent, or Firm* — Whitmyer IP Group LLC

(57) ABSTRACT

An electric switch including a frame, a first stationary contact, a roll element adapted to rotate relative to the frame, a rotating contact stationary fixed to the roll element, and an arc extinguisher plate system. The arc extinguisher plate system includes at least one first arc extinguisher plate for extinguishing an electric arc generated during an opening event between the first stationary contact and a first contact portion of the rotating contact. The at least one first arc extinguisher plate is fixed to the roll element.

17 Claims, 4 Drawing Sheets

ELECTRIC SWITCH

TECHNICAL FIELD

The present invention relates to an electric switch.

BACKGROUND

An electric switch is a device adapted to open and close an electric circuit it is connected to. When an electric circuit is opened by an electric switch, an electric arc whose temperature is thousands of degrees may occur in the electric switch. An electric arc includes ionized gas, which contains a large number of free electrons. Such a gas plasma is electrically conductive.

An electric arc delays transfer of an electric switch from a conducting state to a non-conducting state. Further, an electric arc is often harmful for an electric switch and for an electric assembly comprising the electric switch.

It is known in the art to use arc extinguisher plates for reducing duration of electric arcs in electric switches. An example of known electric switch provided with arc extinguisher plates is described in publication EP 3457 423 A1.

SUMMARY

An object of the present invention is to provide an electric switch which has an improved structure regarding electric arc extinguishing. The objects of the invention are achieved by an electric switch described in the following.

The invention is based on the idea of attaching arc extinguisher plates to a roll element which is provided with a rotating contact of the electric switch, the roll element being adapted to rotate relative to a frame of the electric switch.

An advantage of the electric switch of the invention is that its structure enables efficient arc extinguishing in connection with an opening event of the electric switch. Further, the invention enables simplifying an assembly process of an electric switch since a roll element provided with a rotating contact and arc extinguisher plates can be installed to a frame of the electric switch as a single unit.

BRIEF DESCRIPTION OF THE DRAWINGS

In the following the invention will be described in greater detail by means of preferred embodiments with reference to the attached drawings, in which.

DETAILED DESCRIPTION

Figure 1:
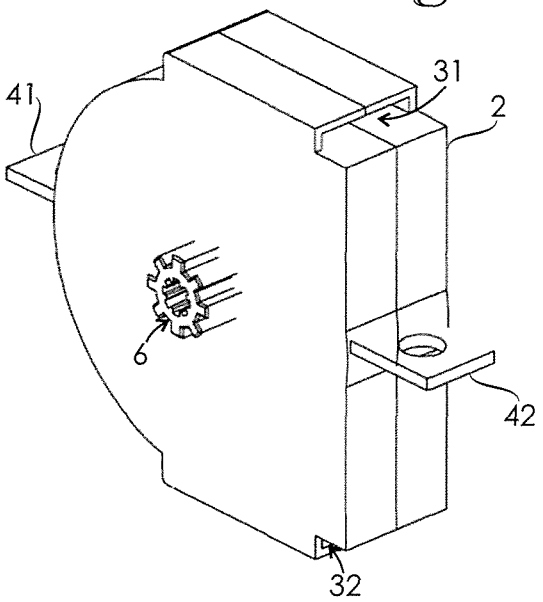
FIG. 1 shows an electric switch according to an embodiment of the invention.

FIG. 1 shows an electric switch according to an embodiment of the invention. The electric switch comprises a frame

2, a first stationary contact 41, a second stationary contact 42, a roll element 6, a rotating contact and an arc extinguisher plate system. The first stationary contact 41 is stationary fixed to the frame 2, and adapted to be connected to a power supply. The second stationary contact 42 is stationary fixed to the frame 2 and adapted to be connected to a load. The first stationary contact 41 and the second stationary contact 42 are made of electrically conducting material. The roll element 6 is made of electrically insulating material, and is adapted to rotate relative to the frame 2 around a rotation axis between a first position and second position.

Figure 2:
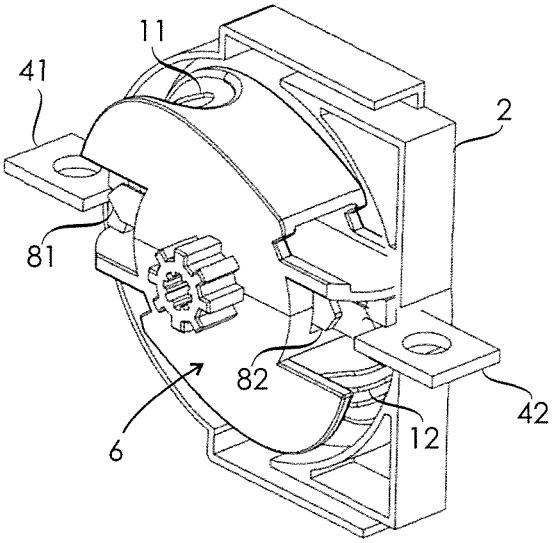
FIG. 2 shows the electric switch of FIG. 1 with one half of a frame removed.
Figure 3:
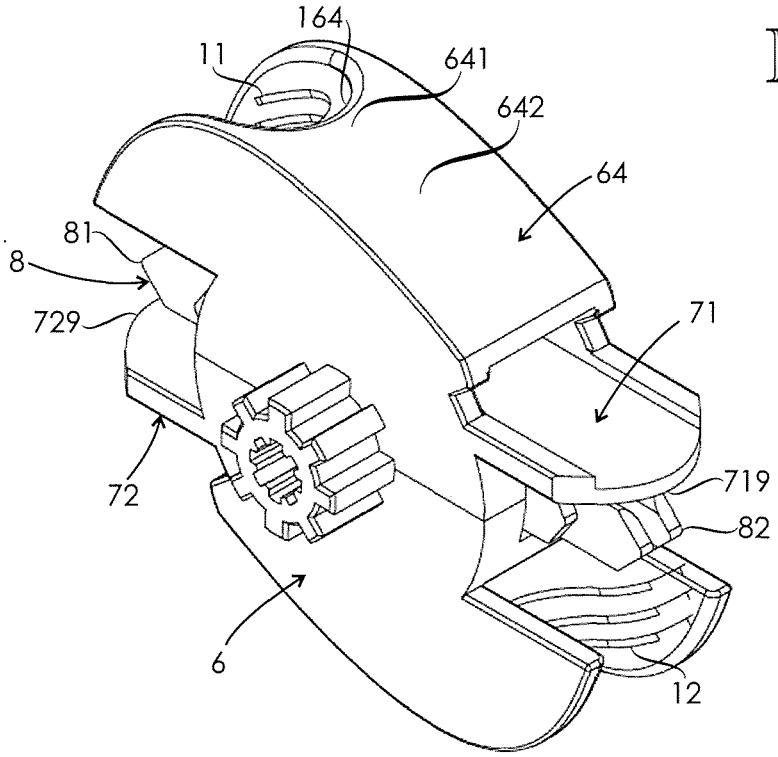
FIG. 3 shows a roll element of the electric switch of FIG. 1.

FIG. 2 shows the electric switch of FIG. 1 with one half of frame 2 removed. FIG. 3 shows the roll element 6 detached from the rest of the electric switch.

The rotating contact 8 is stationary fixed to the roll element 6. The rotating contact 8 is made of electrically conducting material and comprises a first contact portion 81 and a second contact portion 82. Relative to the rotation axis, an angular displacement between the first contact portion 81 and second contact portion 82 is 180°.

Figure 4A:
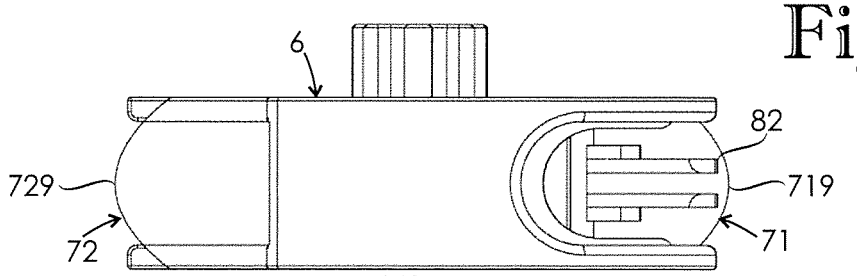
FIGS. 4*a* to 4*e* show the roll element of FIG. 3 from different directions.
Figure 4B:
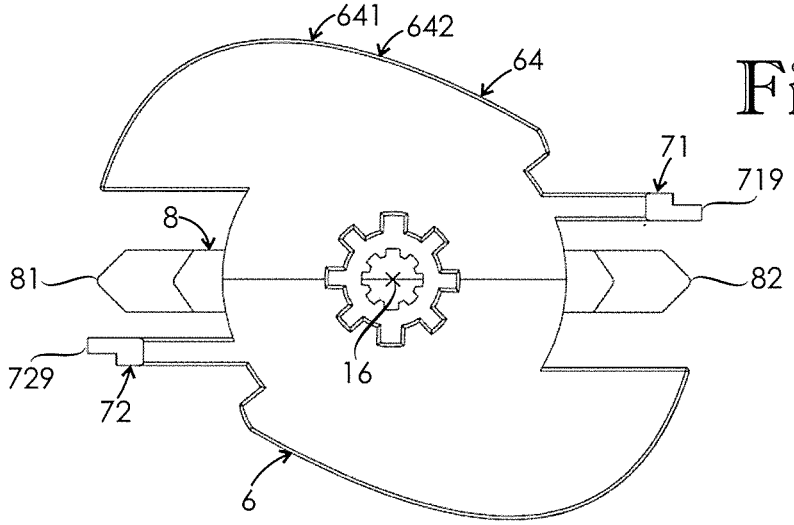
Figure 4C:
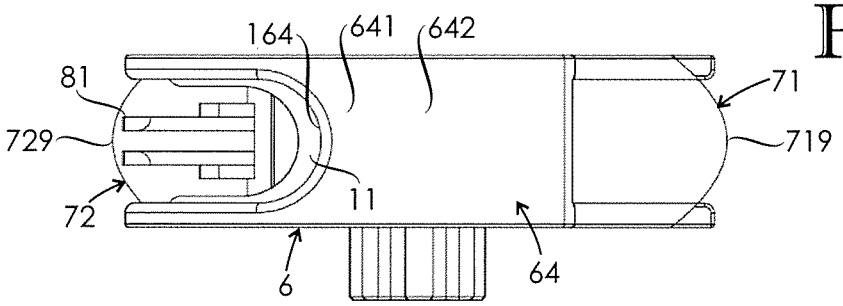
Figure 4D:
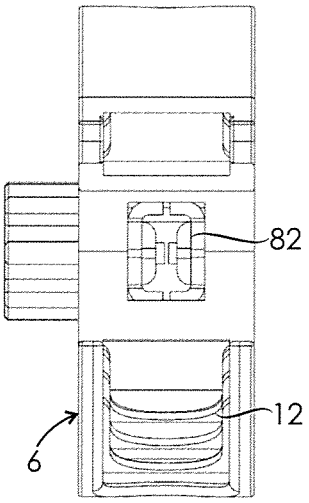
Figure 4E:
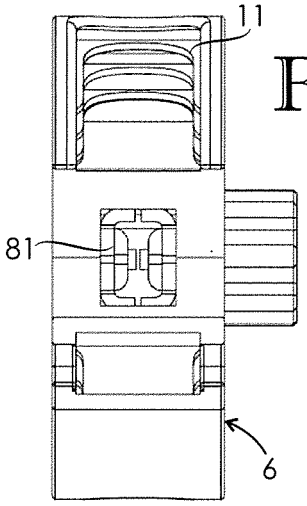

FIGS. 4*a* to 4*e* show the roll element 6 from different directions. FIG. 4*a* shows the roll element 6 from below. FIG. 4*b* shows the roll element 6 from a lateral direction such that the rotation axis 16 is perpendicular to the image plane. FIG. 4*c* shows the roll element 6 from above. In FIG. 4*d* the roll element 6 is seen from the direction of the second contact portion 82 such that the rotation axis is horizontal. In FIG. 4*e* the roll element 6 is seen from the direction of the first contact portion 81 such that the rotation axis is horizontal.

The roll element 6 is adapted to rotate from the first position to the second position in an opening event of the electric switch. The opening event is adapted to break the electrically conductive connection between the first stationary contact 41 and the second stationary contact 42.

Figure 5A:
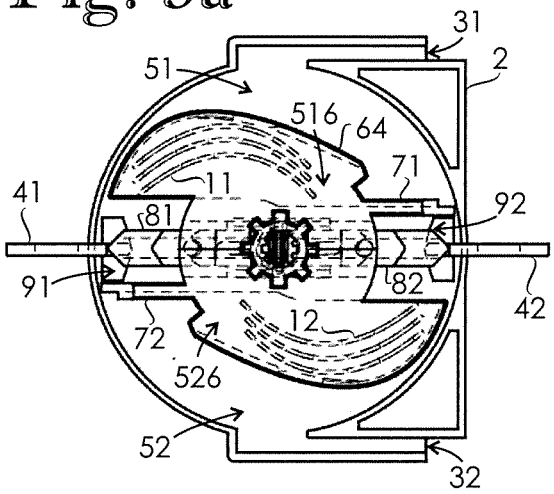
FIGS. 5*a* to 5*d* show the roll element in different positions relative to the frame.
Figure 5B:
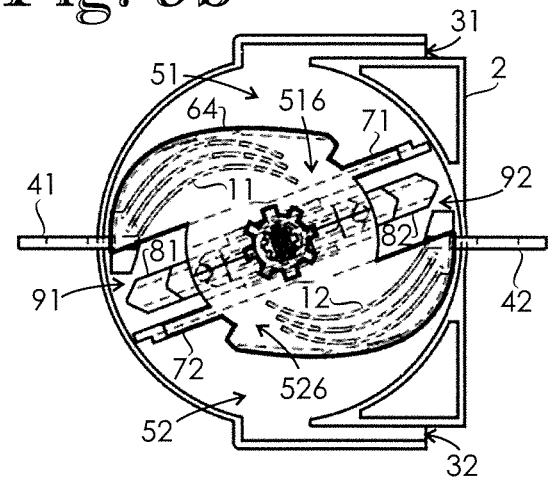
Figure 5C:
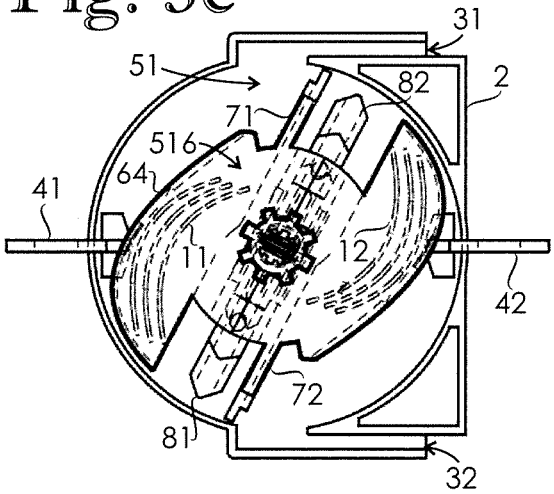
Figure 5D:
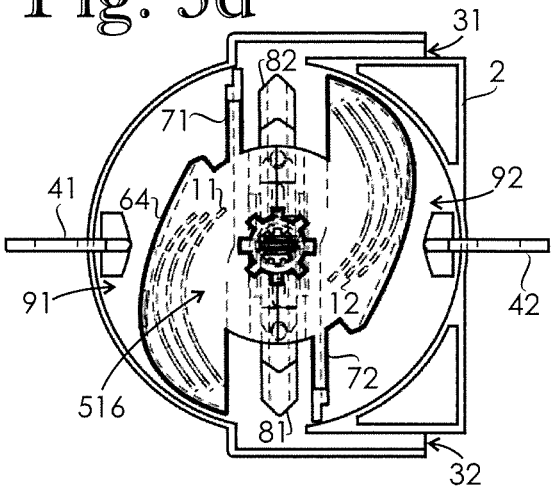

FIGS. 5*a* to 5*d* illustrate the opening event by showing different positions of the roll element 6 during the opening event. In FIG. 5*a*, the roll element 6 is in the first position, wherein the electric switch is in a closed state, or conducting state. In FIG. 5*d* the roll element 6 is in the second position, wherein the electric switch is in an open state, or non-conducting state. Relative to the rotation axis 16, an angular displacement between the first position and the second position is 90°. In an alternative embodiment, an angular displacement between the first position and the second position is greater than or equal to 30°.

FIGS. 5*b* and 5*c* show intermediate positions of the roll element 6 between the first and second positions. In FIGS. 5*a* to 5*d*, the roll element 6 rotates from the first position to the second position anticlockwise.

In the first position of the roll element 6 shown in FIG. 5*a*, the first contact portion 81 is electrically conductively connected to the first stationary contact 41, and the second contact portion 82 is electrically conductively connected to the second stationary contact 42. In the second position of the roll element 6 shown in FIG. 5*d*, the rotating contact 8 is disconnected from the first stationary contact 41 and the second stationary contact 42.

An electrically conductive connection between the first contact portion 81 of the rotating contact 8 and the first stationary contact 41 is adapted to be closed and opened in a first contact zone 91, and an electrically conductive connection between the second contact portion 82 of the rotating contact 8 and the second stationary contact 42 is adapted to be closed and opened in a second contact zone 92.

The arc extinguisher plate system is adapted for extinguish electric arcs inside the frame 2. The arc extinguisher plate system comprises three first arc extinguisher plates 11 for extinguishing an electric arc generated during the opening event between the first stationary contact 41 and the first contact portion 81 of the rotating contact 8. The first arc extinguisher plates 11 are fixed to the roll element 6.

The arc extinguisher plate system further comprises three second arc extinguisher plates 12 for extinguishing an electric arc generated during the opening event between the second stationary contact 42 and the second contact portion 82 of the rotating contact 8. The second arc extinguisher plates 12 are fixed to the roll element 6. Both the first arc extinguisher plates 11 and the second arc extinguisher plates 12 are made of electrically conducting material.

The opening event between the second stationary contact 42 and the second contact portion 82 of the rotating contact 8 occurs simultaneously with the opening event between the first stationary contact 41 and the first contact portion 81 of the rotating contact 8.

The first arc extinguisher plates 11 and the second arc extinguisher plates 12 are stationary fixed to the roll element 6 by means of a supporting connection adapted to prevent detachment of the arc extinguisher plates in every position of the roll element 6. In an embodiment, the supporting connection comprises an adhesive connection between the arc extinguisher plates and the roll element. In an alternative embodiment, the supporting connection comprises a moulding connection between the arc extinguisher plates and the roll element such that the arc extinguisher plates are fixed to the roll element by means of the same moulding process with which at least part of the roll element is formed.

The roll element 6 comprises an arc cutter wall 64 made of electrically insulating material, located at a distance from the rotation axis 16, and extending in directions peripheral and parallel to the rotation axis 16.

The arc cutter wall 64 comprises a first portion 641 and second portion 642 spaced apart in a peripheral direction such that during the opening event, the second portion 642 trails behind the first portion 641. A distance between the rotation axis 16 and the first portion 641 is greater than a distance between the rotation axis 16 and the second portion 642. Herein, the peripheral direction refers to a direction peripheral relative to the rotation axis 16.

The electric switch comprises a gas discharge arrangement for discharging gasses produced by the opening event from the frame 2. The gas discharge arrangement comprises a first gas discharge passage 51, a second gas discharge passage 52, and two gas flow openings 31 and 32. Each of the gas flow openings 31 and 32 is formed in the frame 2, and adapted to provide a route for the gasses from inside the frame 2 to outside the frame 2.

In a longitudinal direction of the electric switch, gas flow openings 31 and 32 are located on the same side of the rotation axis 16 as the second stationary contact 42. Herein, the longitudinal direction of the electric switch is a direction defined by a line between the first stationary contact 41 and the second stationary contact 42. The longitudinal direction of the electric switch is perpendicular to the rotation axis 16. In alternative embodiments, location and number of gas flow openings differ from the embodiment shown in FIG. 1.

The first gas discharge passage 51 originates from the first contact zone 91 and ends to the gas flow opening 31. The second gas discharge passage 52 originates from the second contact zone 92 and ends to the gas flow opening 32.

The roll element 6 forms a roll element section 516 of the first gas discharge passage 51 such that a form of the first gas discharge passage 51 is adapted to change during the opening event. Further, the roll element 6 forms a roll element section 526 of the second gas discharge passage 52 such that a form of the second gas discharge passage 52 is adapted to change during the opening event. A shape of the roll element section 516 of the first gas discharge passage 51 is identical to a shape of the roll element section 526 of the second gas discharge passage 52.

The arc cutter wall 64 defines a part of the roll element section 516 of the first gas discharge passage 51. The roll element section 516 of the first gas discharge passage 51 has an inlet end and outlet end such that gasses produced by the opening event are adapted to flow from the inlet end to the outlet end. A cross-sectional area of the inlet end is greater than a cross-sectional area of the outlet end.

The electric switch comprises a first insulator element 71 adjacent the second contact portion 82 of the rotating contact 8 such that the first insulator element 71 defines a part of the first gas discharge passage 51, and is adapted to increase electric resistance between the first gas discharge passage 51 and the second contact portion 82. The first insulator element 71 is an integral part of the roll element 6. As best seen from FIGS. 3 and 4*b*, the first insulator element 71 is substantially a planar element. FIGS. 2 and 5*a* to 5*d* show how the first insulator element 71 forms a portion of a wall of the first gas discharge passage 51. A free end 719 of the first insulator element 71 extends further from the rotation axis 16 than the second contact portion 82.

Each of the first arc extinguisher plates 11 is a curvilineal arc extinguisher plate which extends in a peripheral direction relative to the rotation axis 16 such that a convex side of the curvilineal arc extinguisher plate faces away from the rotation axis 16. The first arc extinguisher plates 11 are identical to each other.

Each of the second arc extinguisher plates 12 is a curvilineal arc extinguisher plate which extends in a peripheral direction relative to the rotation axis 16 such that a convex side of the curvilineal arc extinguisher plate faces away from the rotation axis 16. The second arc extinguisher plates 12 are identical to each other and to the first arc extinguisher plates 11.

The first arc extinguisher plates 11 are located partially in the roll element section 516 of the first gas discharge passage 51.

In a longitudinal direction of the roll element 6, more than 50% of each first arc extinguisher plate 11 is located on the same side of the rotation axis 16 as the first contact portion 81 of the rotating contact 8. Herein, the longitudinal direction of the roll element 6 is a direction defined by a line between the rotation axis 16 and a free end of the first contact portion 81, the line being perpendicular to the rotation axis 16.

FIG. 5*b* shows an intermediate positions of the roll element 6 in which the first contact portion 81 of the rotating contact 8 has just disengaged from the first stationary contact 41, wherein in a use situation an electric arc has been generated between the first stationary contact 41 and the first contact portion 81 of the rotating contact 8. The use situation is a situation where the opening event disconnects a current-carrying electric circuit between the first stationary contact 41 and the second stationary contact 42.

Over 80% of gasses produced by the electric arc flow from the first contact zone 91 to the gas flow opening 31 though the roll element section 516 of the first gas discharge passage 51. In an alternative embodiment, over 50% of gasses produced by the electric arc flow from the first contact zone to the gas flow opening though the roll element section of the first gas discharge passage.

Gasses are prevented from flowing from the first contact zone 91 to the gas flow opening 32 by a second insulator element 72 adjacent the first contact portion 81 of the rotating contact 8. The second insulator element 72 is an integral part of the roll element 6. The second insulator element 72 is substantially a planar element. A free end 729 of the second insulator element 72 extends further from the rotation axis 16 than the first contact portion 81.

In the intermediate position of FIG. 5*b*, the free end 729 of the second insulator element 72 is adjacent to an inner wall of the frame 2 for obstructing the gasses from flowing from the first contact zone 91 to the gas flow opening 32. Said inner wall of the frame 2 is rotationally symmetrical such that the second insulator element 72 remains adjacent to the inner wall between the intermediate positions of FIGS. 5*b* and 5*c*.

The arc cutter wall 64 is adapted to prevent the gasses produced by the electric arc in the first contact zone 91 from bypassing the roll element section 516 of the first gas discharge passage 51 on their way to the gas flow opening 31. In order to do that, the arc cutter wall 64 is located relatively close to an inner wall of the frame 2.

In the intermediate position of FIG. 5*c*, each of the first arc extinguisher plates 11 has reached a position in which a radial line between the rotation axis 16 and the first contact zone 91 passes through the first arc extinguisher plate 11.

FIGS. 6*a* to 6*d* show one of the first arc extinguisher plates 11 from different directions. The first arc extinguisher plate 11 comprises two side branches 101 and 102 extending in the electric switch in the peripheral direction, and a connecting branch 103 extending in a direction parallel to the rotation axis 16, and connecting the two side branches 101 and 102 to each other.

Figure 6A:
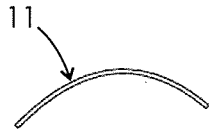
FIGS. 6*a* to 6*d* show a first arc extinguisher plate of the electric switch of FIG. 1 from different directions.
Figure 6B:
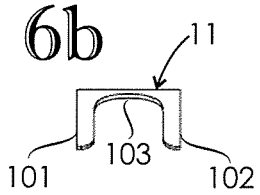
Figure 6C:
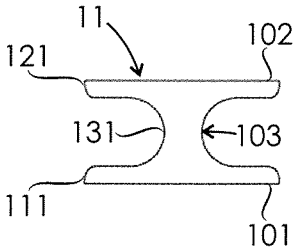
Figure 6D:
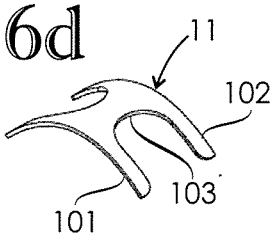

The first arc extinguisher plate 11 has an H-shape such that it is symmetrical with respect to a symmetry plane passing through the connecting branch 103. In FIG. 6*c*, the symmetry plane is perpendicular to the image plane, and extends vertically.

The connecting branch 103 has an inwardly curved first edge 131 such that in the peripheral direction, a distance between a middle portion of the connecting branch 103 and free ends 111 and 121 of the two side branches 101 and 102 is greater than a distance between lateral portions of the connecting branch 103 and the free ends 111 and 121 of the two side branches 101 and 102. The middle portion of the connecting branch 103 is a portion in the middle of the connecting branch 103 in a direction parallel to the rotation axis.

The arc cutter wall 64 has an inwardly curved first edge 164 such that during the opening event a middle portion of the inwardly curved first edge 164 is trailing behind lateral portions of the inwardly curved first edge 164. During the opening event, the middle portion of the inwardly curved first edge 164 of the arc cutter wall 64 is trailing behind the inwardly curved first edge 131 of the connecting branch 103 of one of the first arc extinguisher plates 11. An angular distance relative to the rotation axis 16 between the first contact portion 81 and the middle portion 164 of the inwardly curved first edge of the arc cutter wall 64 is approximately 60°. In an alternative embodiment, an angular distance relative to the rotation axis between the first contact portion and the middle portion of the first edge of the arc cutter wall is in a range of 20° to 80°.

Figure 7:
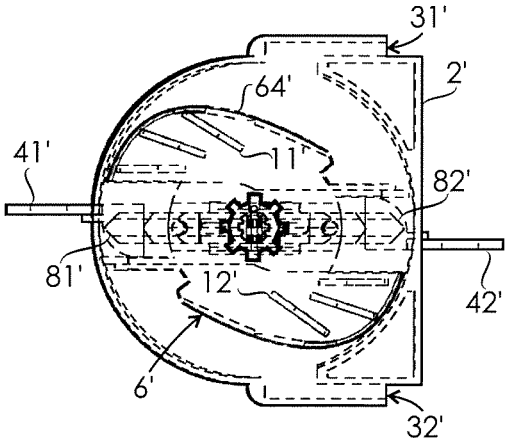
FIG. 7 shows an internal structure of an electric switch according to another embodiment of the invention.

FIG. 7 shows an internal structure of an electric switch according to another embodiment of the invention, in which the arc extinguisher plate system comprises three first arc extinguisher plates 11' for extinguishing an electric arc generated during the opening event between the first stationary contact 41' and the first contact portion 81' of the rotating contact.

The first arc extinguisher plates 11' are fixed to the roll element 6', and are planar, U-shaped elements. Direction of each of the first arc extinguisher plates 11' diverges from a radial direction, which is perpendicular relative to the rotation axis. Further, direction of each of the first arc extinguisher plates 11' diverges from a direction of the other first arc extinguisher plates 11'. Each of the first arc extinguisher plates 11' is adapted to be in contact with gasses produced by the opening event.

Except for the arc extinguisher plates 11' and 12', the electric switch of FIG. 7 is identical to the electric switch of FIG. 1. In FIG. 7, features corresponding to features of the electric switch of FIG. 1 are denoted with the same reference numbers but distinguished by apostrophes.

It will be obvious to a person skilled in the art that the inventive concept can be implemented in various ways. The invention and its embodiments are not limited to the examples described above but may vary within the scope of the claims.

The invention claimed is:

1. An electric switch comprising:

a frame;

a first stationary contact stationary fixed to the frame, and adapted to be connected to a power supply;

a roll element adapted to rotate relative to the frame around a rotation axis between a first position and second position;

a rotating contact stationary fixed to the roll element, and including a first contact portion such that in the first position of the roll element the first contact portion is electrically conductively connected to the first stationary contact, and in the second position of the roll element the rotating contact is disconnected from the first stationary contact, wherein electrically conductive connection between the first contact portion of the rotating contact and the first stationary contact is adapted to be closed and opened in a first contact zone; and an arc extinguisher plate system for extinguish electric arcs inside the frame, the arc extinguisher plate system including at least one first arc extinguisher plate for extinguishing an electric arc generated during an opening event between the first stationary contact and the first contact portion of the rotating contact, wherein the at least one first arc extinguisher plate is fixed to the roll element.

2. The electric switch according to claim 1, wherein the roll element comprises an arc cutter wall made of electrically insulating material, located at a distance from the rotation axis, and extending in directions peripheral and parallel to the rotation axis.

3. The electric switch according to claim 2, wherein the arc cutter wall comprises a first portion and second portion spaced apart in the peripheral direction such that during the opening event, the second portion trails behind the first portion, wherein a distance between the rotation axis and the first portion is greater than a distance between the rotation axis and the second portion.

4. The electric switch according to claim 2, wherein the electric switch comprises a gas discharge arrangement for discharging gasses produced by the opening event from the frame, the gas discharge arrangement including a first gas discharge passage and at least one gas flow opening, wherein the at least one gas flow opening is formed in the frame, and adapted to provide a route for the gasses from inside the frame to outside the frame, the first gas discharge passage originating from the first contact zone and ending to the at least one gas flow opening.

5. The electric switch according to claim 4, wherein the roll element forms a roll element section of the first gas discharge passage such that a form of the first gas discharge passage is adapted to change during the opening event.

6. The electric switch according to claim 5, wherein the arc cutter wall defines a part of the roll element section of the first gas discharge passage.

7. The electric switch according to claim 6, wherein the at least one first arc extinguisher plate comprises at least one curvilineal arc extinguisher plate which extends in a peripheral direction relative to the rotation axis such that a convex side of the at least one curvilineal arc extinguisher plate faces away from the rotation axis, and the at least one curvilineal arc extinguisher plate is located at least partially in the roll element section of the first gas discharge passage.

8. The electric switch according to claim 5, wherein the roll element section of the first gas discharge passage has an inlet end and outlet end such that gasses produced by the opening event are adapted to flow from the inlet end to the outlet end, wherein a cross-sectional area of the inlet end is greater than a cross-sectional area of the outlet end.

9. The electric switch according to claim 8, wherein the at least one first arc extinguisher plate comprises at least one curvilineal arc extinguisher plate which extends in a peripheral direction relative to the rotation axis such that a convex side of the at least one curvilineal arc extinguisher plate faces away from the rotation axis, and the at least one curvilineal arc extinguisher plate is located at least partially in the roll element section of the first gas discharge passage.

10. The electric switch according to claim 5, wherein the at least one first arc extinguisher plate comprises at least one curvilineal arc extinguisher plate which extends in a peripheral direction relative to the rotation axis such that a convex side of the at least one curvilineal arc extinguisher plate faces away from the rotation axis, and the at least one curvilineal arc extinguisher plate is located at least partially in the roll element section of the first gas discharge passage.

11. The electric switch according to claim 1, wherein the at least one first arc extinguisher plate comprises at least one curvilineal arc extinguisher plate which extends in a peripheral direction relative to the rotation axis such that a convex side of the at least one curvilineal arc extinguisher plate faces away from the rotation axis.

12. The electric switch according to claim 11, wherein in a longitudinal direction of the roll element, more than 50% of the at least one curvilineal arc extinguisher plate is located on the same side of the rotation axis as the first contact portion of the rotating contact.

13. The electric switch according to claim 11, wherein the at least one curvilineal arc extinguisher plate comprises two side branches extending in the peripheral direction, and a connecting branch extending in a direction parallel to the rotation axis, and connecting the two side branches to each other.

14. The electric switch according to any claim 1, wherein the at least one first arc extinguisher plate is adapted to reach during the opening event a position in which a radial line between the rotation axis and the first contact zone passes through the at least one first arc extinguisher plate.

15. The electric switch according to claim 1, wherein the electric switch comprises a second stationary contact stationary fixed to the frame and adapted to be connected to a load, and the rotating contact includes a second contact portion such that in the first position of the roll element the second contact portion is electrically conductively connected to the second stationary contact, and in the second position of the roll element the rotating contact is disconnected from the second stationary contact, wherein electrically conductive connection between the second contact portion of the rotating contact and the second stationary contact is adapted to be closed and opened in a second contact zone, and the arc extinguisher plate system includes at least one second arc extinguisher plate for extinguishing an electric arc generated during the opening event between the second stationary contact and the second contact portion of the rotating contact, and the at least one second arc extinguisher plate is fixed to the roll element.

16. The electric switch according to claim 15, wherein the electric switch comprises a first insulator element adjacent the second contact portion of the rotating contact such that the first insulator element defines a part of the first gas discharge passage, and is adapted to increase electric resistance between the first gas discharge passage and the second contact portion.

17. The electric switch according to claim 16, wherein a free end of the first insulator element extends further from the rotation axis than the second contact portion.

* * * * *